United States Patent [19]

Muller

[11] 3,996,056

[45] Dec. 7, 1976

[54] DIAZOTYPE REPRODUCTION LAYER FORMED FROM MATRIX OF SPHERIC PARTICLE POLYSTYRENE PIGMENT AND DIAZOTYPE COMPONENTS

[75] Inventor: Peter Muller, Port Washington, N.Y.

[73] Assignee: Andrews Paper & Chemical Co., Port Washington, N.Y.

[22] Filed: Feb. 5, 1975

[21] Appl. No.: 547,206

Related U.S. Application Data

[63] Continuation-in-part of Ser. No. 349,817, April 10, 1973, abandoned.

[52] U.S. Cl. ..... 96/75; 96/13; 96/49; 96/83; 96/91 R

[51] Int. Cl.[2] ..... G03C 1/60; G03C 1/78

[58] Field of Search ..... 96/75, 91 R, 49, 83

[56] References Cited

UNITED STATES PATENTS

| | | | |
|---|---|---|---|
| 2,603,564 | 7/1952 | Maxcy | 96/91 R |
| 2,726,956 | 12/1955 | Jahoda | 96/75 |
| 2,781,265 | 2/1957 | Von Meister | 96/75 |
| 2,805,159 | 9/1957 | Unkauf | 96/75 |
| 3,027,256 | 3/1962 | Klimkowski et al. | 96/75 |
| 3,284,201 | 11/1966 | Meijs et al. | 96/75 |
| 3,370,949 | 2/1968 | Van Groenland | 96/75 |
| 3,409,434 | 11/1968 | Landbarge et al. | 96/75 |
| 3,632,375 | 1/1972 | Gipe | 96/75 |

*Primary Examiner*—Charles L. Bowers, Jr.
*Attorney, Agent, or Firm*—Kane, Dalsimer, Kane, Sullivan and Kurucz

[57] ABSTRACT

Plastic pigment spheric particles which form a matrix for diazotype reproduction materials are applied to a base sheet. Whether the diazo sensitizing solution is included in admixture with spheric plastic pigment particles or is applied thereafter as a second coating, a matrix is formed having a sensitized diazo layer dispersed throughout. Such diazo matrices permit control of contrast ratios over a wide range. Also such diazo matrices are transferable. The diazo matrix image can be made water fast by an after treatment by means of a solvent. Such a matrix lends itself to the heat development process by retaining the heat generated development agents within the matrix due to its thermoplastic character. In another aspect of the invention multicolor diazo reproduction on a single base sheet employing consecutive overcoatings of the matrix and diazo sensitizing solution after each development can be achieved.

10 Claims, 10 Drawing Figures

Reflection Density
1.5
1.0
0.5
Light Transmission Density
0.5
1.0
1.5

Reflection Density
0.5
1.0
1.5
Light Transmission Density
0.5
1.0
1.5

Reflection Density
0.5
1.0
1.5
Light Transmission Density
0.5
1.0
1.5

DIAZOTYPE REPRODUCTION LAYER FORMED FROM MATRIX OF SPHERIC PARTICLE POLYSTYRENE PIGMENT AND DIAZOTYPE COMPONENTS

CROSS-REFERENCE TO RELATED APPLICATIONS

This application is a continuation-in-part application of U.S. application Ser. No. 349,817 filed Apr. 10, 1973, now abandoned.

BACKGROUND OF THE PRIOR ART

Diazotypy is a copying process for making copies from translucent originals by exposing then to ultraviolet light while in optical contact with a diazotype copying sheet, and developing with ammonia, or heat, or a liquid developer to form a print dye.

The diazotype process is based on reactions typical to the components used and on the time controlled sequence of these reations. The main function components of the diazotype process are:

1. Aromatic diazo compounds of more or less pronounced yellow color which absorb ultraviolet light to undergo a photolytical decomposition to colorless products. The diazo compounds can be mixed with azo couplers when maintained in acid environment to prevent precoupling and then by changing the pH from an acid to an alkaline environment, the coupling reaction can take place to produce an azo dye.

2. Couplers are aromatic compounds with phenolic OH groups with or without other substitutions, or other organic compounds containing activated methylene groups. The couplers are colorless compounds which can be mixed with the diazo compounds as noted above without reacting with them while in an acid environment but by changing the acid environment to an alkaline environment the coupling reaction takes place to form an azo dye. Also, when employing a liquid development system, a coupler can be added to the developer solution rather than mixed with the diazo compound as a dry component.

Other components may be added to the diazotype layers to obtain various effects by controlling the reaction rates of the coupling reactions.

The light sensitive diazo compounds, the dye forming couplers, and the azo dyes forming the print image are all low molecular weight compounds which do not polymerize and do not resinate. The main performance parameters of a diazotype material are the light sensitivity and print dye strength. Both depend substantially on the distribution of the diazo compounds and couplers both laterally and in depth in the surface zone of the base support sheet and on the compatibility and dyeability of the carrier material. It can be expected that the eveness of distribution will be greatly enhanced by an appropriate matrix material for the diazotype compounds similar to silver halide photography where gelatin is used as the matrix. The sensitometric characteristics of the light sensitive layer are greatly influenced by the carrier, for example, see Light Sensitive Systems by Kosar, page 32, published by John Wiley & Sons Inc., 1965.

The best known matrix in the silver halide photographic process is gelatin. It is also known that the quality of the gelatin and the nature of the dispersion of the silver halide grains in the gelatin control the performance of the photographic material. The gelatin is the matrix in which the light sensitive photographic material is embedded.

The diazotypy uses mostly paper as a base support material for economical and practical reasons. The paper fibers of diazotype base papers have undergone a sizing process which makes them sufficiently receptive to the diazotype components when applied from an aqueous solution without excessive absorption into the fibrous structure of the base support sheet. The fibrous structure of the base paper, however, makes it impossible to obtain a uniform grainless print because the degree of uniformity depends strongly upon the degree of sizing which has been applied to the base paper. Also, the base paper can have a strong deteriorating effect on the diazotype product due to the potential contaminating impurities contained in the paper itself. The in-depth distribution of the diazotype components forcibly follows the fibrous structure by capillarity which makes uniformity impossible.

Numerous efforts have been made to remedy these problems and disadvantages by introducing potential matrix materials for diazotypes, for example, gelatin and other hydrophilic colloids such as starch, cellulose-ethers, alginates, polyacrylic acid, casein, polyvinylpyrrolidone and ethylene-oxide polymers. However, these materials do not produce the desired results for reasons for example, of limited compatibility, of excessive viscosity, insufficient flowability. The use of polyvinyl acetate dispersions resulted in a number of problems and disadvantages such as limited compatibility, and softness of print surface among others. Moreover, most of these coating applications cannot be evenly dispersed nor readily or uniformly applied to the paper surface. The most successful achievement has been the introduction of precoating (TAPPI Vol. 48, No. 3, August 1965). Particularly the use of selected non-colloidal size pigment precoats reduced the influence of the paper base on the performance of the diazotype and results in more uniform print surfaces and better print contrast which is desirable for line reproduction work to which diazotypes were mostly restricted. These precoating applications, however, cannot be controlled to obtain low contrast diazotypes which would be useful for continuous tone reproductions. Such precoat layers cannot be increased beyond an optimum thickness since the diazo components tend to distribute unevenly into the deeper recesses of the precoat layer. In other words, the precoat layers are more like planar layers and do not provide a steric matrix for the diazotype components.

Heretofore, a preferred matrix for diazotype components has been cellulose acetate or cellulose aceto butyrate; they form either self-supporting films or can be coated to another base support. the diazotype components are compatible with these materials. However, diazotype products with these components as a matrix are expensive to produce because of the high cost of the materials and the special preparation and coating techniques that are necessary which require the use of organic solvents as dispersing agents to apply these water insoluble materials to the base sheet.

The diazotype process is a positive, working, bleach-out process. It works by decomposing the diazo material which is exposed to ultraviolet light thereby forming a print in those areas where the opaque image of the master was placed. Thus, flash exposure of diazotype layers results in decomposition of the diazo components and more or less proportional reduction of potential print dye formation. On the other hand, the silver halide process uses light exposure of the sensitive layer to generate a latent image and it is the concentration of the light which contributes to the strength of the image dye formation.

The sensitometric characteristics of diazotype layers are quite different from those of silver halide layers and accordingly it was generally assumed that diazo-type layers are useful only for line work reproductions (Kosar - Light Sensitive Systems, page 302). Their sensitometric curve has no or only a very short straight line portion with a short toe section that turns quickly into a convex zone and flattens out rapidly at higher densities. Accordingly, the greatest reprint contrast ratio of dizaotypes occurs in the upper part of the toe section. Kosar in his article also mentions that unlike silver halide photographic layers, the sensitometric curve of diazotype layers can only be affected very slightly by the formulation of the sensitizing solution, the exposure or development.

The principal application for diazotype material is for line work reproduction and the simplicity of the process and its economy when compared with other reproduction processes of more recent dates resulted in its wide use. Improvements of the diazotype process were directed in many cases towards improving its characteristics for line reproductions by widening the high contrast zone of the sensitometric curve. As indicated above, however, no more than a slight improvement can be obtained by reformulation of the sensitizing solution, and only the introduction of the precoating process resulted in improvements with a substantial widening of the high contrast zone of the sensitometric curve. Excellent diazotype copies are thus obtained from line work masters on clear or matte film. Also, satisfactory reproductions are obtained from such masters on transparent paper of homogeneous translucency.

Very poorly readable copies are obtained, however, from typewritten letters on common commercial stationary paper because of its uneven formation and because of intentional decorative effects of the stationary such as cockle in onion skin, water marks, etc. The natural or artificial patterns of inhomogeneity optically constitute differences in transmission density of the sheet and thus have an additive effect on the image dye pattern where they overlap with it, and an imaging effect of their own pattern in the otherwise image-empty areas of the sheet. Because the transmission densities of these patterns are mostly rather close to the relatively lwo transmission densities of the typewritten information the patterns only reproduce on the diazotype in the high contrast range of the toe zone of the sensitometric curve. The result for the viewer of the copy is a weak image line among a rough pattern of specks of similar reflection density. This shortcoming has discouraged the use of diazotypes for copying from letterhead masters or masters on paper with wild formation patterns in favor of the use of more expensive reproduction methods.

Lowering the contrast ratio of diazotypes towards a ratio of one particularly in the upper toe zone and extending it towards the zone of higher densities would overcome these problems and disadvantages and permit the use of diazo reproduction materials in applications which heretofore have not been feasible with diazotypes.

Various approaches have been made in the past with such an aid in mind; however, this work has been restricted to diazotype film coating layers; for example, Dutch Patent No. 80,603 suggests the use of a mixture of two diazo compounds with different absorption characteristics for printing light in order to obtain a lower print contrast for tonal reproductions. Also, U.S. Pat. No. 3,484,241, suggests the use of two diazotype layers with the diazo components having different sensitivities. Also, U.S. Pat. Nos. 3,069,268; 3,365,269, 3,498,791 and 3,661,591 recommend the use of particular ultraviolet absorbing substances which are applied in single or double layers to the base sheet and in which these ultraviolet light absorbing substances are spread evenly through the depth of the layers of consistent thickness.

These teachings have been found useful in diazo micro films but applications to paper have not been successful, probably because the thickness of the diazo coating layers on paper is never consistent and the coating layer tends to intermingle with the fibrous structure of the paper.

Another U.S. Pat. No. 2,603,564 employs certain pigments or fillers in high concentrations and applies them to the diazo layers intermingled with hydrophobic organic resin binders in an attempt to obtain a lower contrast ratio for diazo reproductions. However, these organic resin binders are soluble in organic solvents only and, therefore, require an organic solvent system. Such a system has the disadvantage that it is difficult to homogeneously distribute the pigments in the diazo coating solution and it is difficult to avoid sedimentation. Also, to apply such a system a more expensive base paper must be employed with solvent holdout and such a system would require the use of high viscosity solutions and modification of the coating procedure.

An upgraded diazo reproduction material has been obtained through the use of baryta coated base paper. Diazo sensitized baryta coated base paper produces excellent diazo-type prints but the sensitometric curve of such layers still show the high contrast ratio in the toe zone and good half tone prints are only obtained through the use of screened master film originals. Heavy weight base stock is necessary when using baryta coated paper since the coating layers have a weight of at least 30 grams per square meter. These heavy baryta coating layers are thick and can easily fracture when folded and, further, such thick layers cause curl problems which are difficult if not impossible to overcome. Also, the high cost for making baryta coated materials limits their use to only special applications.

The need for diazo reproduction materials which are inert against handling and are waterfast has always been apparent. The diazo materials which can be used for these purposes are diazotype films and lacquer coated diazotype papers which may be translucent or opaque. However, these particular diazotype materials, although the reproductions obtained are of high quality, are expensive to make and their manufacture is time consuming. To perform the lacquering process on paper with a regular calendar finish is difficult to achieve since pinholes often occur and these pinholes form uneven tonal qualities in the diazo print. These pinhole or crater effects can be minimized when a baryta coated base is used for the lacquering process. It is necessary to employ thick lacquer layers to avoid penetration of components from the organic solvent solution of the diazo components into the base which would result in unevenness in the tonal qualities of the diazo reproduction. Incorporation of diazotype components into organic solvent lacquer systems result in a yellow-brown discoloration of the print background. Such type of discoloration does not occur, or only to a much lesser degree from the use of aqueous sensitizing solutions, which, however, do not take to lacquer layers. Since the above diazo reproduction materials are expensive they are not widely used throughout the industry.

The diazotype process is used to make copies of different colors such as blue, yellow, brown, red, black, etc., but is not used to make multi-color copies. A two color process for diazo reproductions with shade differences between the full tones and intermediate tones has been suggested in U.S. Pat. No. 2,542,715 and No. 2,542,716. To accomplish this a combination of slow and fast acting azo couplers are used, for example, diazo reproduction materials which have been sensitized with 2-diazo-1-napthol-5-sulfonic acid and phloroglucinol as the coupler, produce prints with blue shades in full tones and light red shades in the intermediate tone areas.

In the past multi-color diazo reproductions could only be achieved through a composition of transparent overlay films. Attempts have been made to achieve multicolored diazo reproductions on a single base sheet but have been unsuccessful. Attempts have been made in which the diazo print in one color is developed and then the same diazo print is resensitized with a different diazo sensitizing composition for a different color and printed and developed and then a third resensitizing and so forth have been applied to achieve a multi-color print. These attempts have failed because each time the diazo reproduction is resensitized the underlying dye is not sufficiently resistent to the acid sensitizing solution and may decompose or bleed out or both. To overcome this problem the resensitizing solution was carried out employing organic solvent solutions. However, it is necessary to anchor the developed top layer to the under layer whereby these solvents tend to dissolve out the azo dye of the underlying print image.

Image transfer is very useful for reflex copying processes and for photomontage. Conventional diazotype reproduction materials do not lend themselves to such applications.

Diazotype layers on paper are intermingled with the fibrous paper surface and are resistant to contact transfer to a receiver sheet unless a solvent for the diazo, such as water, or solvents for the azo print dye are used for the transfer which, however, results in strong dye bleeding and image blurring.

Diazotype layers which are imbedded in a wax type coating are more easily contact transferable through pressure or solvents or swelling agents for the wax layers but such composites are impractical for diazotype reproduction media because the coating layer is insufficiently resistant to manual handling and to processing of the sheets in printing machines, and moreover the ammonia development is strongly affected because the waxy layer is not previous enough to ammonia and water vapors.

SUMMARY OF THE INVENTION

It is an object of the present invention to overcome the disadvantages and difficulties of the prior art and to provide an improved diazotype copying material with a soft gradation within a large range of their sensitometric curves for wide printing latitude and for half tone work from continuous tone masters.

It is another object of the invention to provide a diazotype material for graphic arts application with a pronounced high contrast ratio.

Still another object of the invention is to provide a high contrast water fast and water repellent diazotype material having the characteristics of a lacquer coated material but which can be achieved at low cost and by employing a more efficient and economic process than heretofore possible.

It is a further object of the invention to provide an after treatment which will produce an extremely high contrast diazo reproduction which heretofore could be achieved only with the lacquer coated diazotypes process.

Still a further object of the invention is to provide a diazotype intermediate copying material on translucent base supports in a single path through conventional aqueous coating machines.

Still a further object of the invention is to provide a multi-color diazotype reproduction material on a support base and method therefor.

It is a further object of the invention to provide heat developable diazotypes employing conventional aqueous diazotype coating machines.

Also, it is an object to provide a new and improved diazotype reproduction material without the necessity of applying a separate precoating layer.

It is a further object of this invention to obtain transferable diazotype layers.

It is a further object of this invention to obtain transferable diazotype layers for transfer prior to development and for development on a receiver sheet during or after transfer.

My invention generally contemplates the provision of a diazotype reproduction material comprising a matrix of plastic pigment spheric particles having a particle size of at least 0.15 microns and being applied as a layer to a support sheet. Light sensitive diazo components are associated with the matrix so that when the diazotype reproduction material is developed by exposure behind a master to ultraviolet light an improved diazo reproduction is achieved having excellent tonal reproduction qualities through the entire exposure range.

It has now been found that plastic spherically shaped pigments are capable of forming a matrix for diazotype layers with the result of a greatly improved diazo reproduction material. The spherically shaped plastic pigments have a particle size of at least 0.15 microns. These pigments may be applied to the base sheet as an undercoat prior to receiving the diazo sensitized solution in a second operation, or the plastic particles can be mixed with the sensitizing diazotype solution and applied simultaneously in a single coating operation to the base sheet.

The spherically shaped plastic pigment particles may be held together and affixed to the support sheet by use of a suitable bonding aid such as polyvinyl acetate or copolymer latices and/or hydrophilic colloids or by heating the particles to their softening point or by applying a solvent to the coating layer and then evaporating the solvent.

In practicing the invention herein it has been found that diazotype coating layers intermingle with the plastic spherically shaped pigments and when applied to the base sheet using conventional diazotype coating machines form dry, non-tacky surfaces which feel smooth to the touch. These coated diazotype materials may be readily processed using conventional printing and devloping machines. The print surfaces of these diazotype reproduction materials have good wet strength and are wettable with water. The diazo reproduction materials of the invention herein may be subjected to an after treatment with a solvent or a solvent mixture which swells or partially dissolves the spherically shaped plastic pigments without dissolving any of the diazotype components dispersed in the matrix, and which treatment after evaporation of the solvent renders the print surface water fast and water repellent. Also, the application of heat to the coating layer which softens the plastic spherically shaped plastic materials beyond its fritting point will cause a transformation of the diazo reproduction material from wettability to water insensitivity.

When practicing the invention herein the diazotype layers intermingled with the plastic pigments produce prints having a very fine grain, deep colors and surprisingly wide printing latitude. The sensitometric curves of the diazotypes differ substantially from those of conventional diazotypes prepared with silica or other conventional precoats. It is found that the sensitometric curve does not flatten out before reaching the maximum density and the lower part of the toe zone with contrast ratios of below 1 stretch into much higher density areas. Bar gammas of from 1.2 to 0.75 can be obtained. Also, a further straightening out of the sensitometric curve over its entire length can be obtained through flash exposure prior to printing with a drop of the bar gammas by 25% with maximum density loss of only 15% while a flash exposure on conventional diazotypes for a bar gamma drop of 25% results in a maximum density drop of 30% with no substantial change in the tendency of the sensitometric curve but rather pronounced flattening out towards the maximum density area.

It has also been found by practicing the invention herein that diazotypes with the spherically shaped pigment particles intermingled throughout the coating layer, when heated to the softening point of the plastic particles or when treated with a solvent which swells or partially dissolves the plastic particles, after drying, produce prints with a very high print contrast having a bar gamma of 2.5. The sensitometric curve has a long flattened high density range which makes such diazotype material very useful for line reproduction in lithographic proofing applications where conventional diazotypes are less useful because the flat high density range of their sensitometric curves is too short.

It has also been found that base paper coated on the front side with a diazotype composition admixed with the spherically shaped pigment particles of the invention herein and coated on the back side with the spherically shaped particles of the invention herein with or without an additional binder and after drying with both sides treated with a solvent or a solvent mixture that swells or partially dissolves the plastic pigments and thereafter drying produces a completely water resistant diazotype reproduction material having the same characteristics as those obtained through the much more complicated and expensive lacquer coating techniques with organic solvent coating systems.

In practicing this invention it has been found that latex dispersions of the spherically shaped plastic pigment particles with a small addition of binder as undercoat or mixed with the diazotype components for simultaneous application spread and adhere substantially uniformly on foil and film base sheets whereas heretofore such coatings required organic solvent systems.

It has also been found that the diazotype components which are necessary for diazotype layers distribute in depth throughout the coating layer of the spherically shaped pigment particles of the invention herein even if the plastic particles are applied in a separate coating operation prior to the application of the diazo sensitizing layer. Such a result is not obtained with conventional pigment precoats for diazotype reproductions which require higher binder levels to prevent physical rub-off. The higher binder levels in turn keep the diazotype components in the upper stratum of the precoat layer. As noted above, the spherically shaped plastic pigment particles of the invention herein form a matrix for the diazotype components and as a result such plastic pigment layers readily accommodate high print dye concentrations which in conventionally prepared precoated diazotype reproduction materials concentrate on the print surface which results in a bronzing appearance and a readily rubbing off during handling and print processing.

I have also found that coating layers of diazotype components intermingled with the plastic pigments of this invention are easily transferable from the carrier base to a receiver surface. I have found that not only the transfer of the developed print image layer to a non-treated receiver sheet such as bond paper for example is easily obtained but also light printed non-developed layers can be easily transferred to a receiver sheet which can be treated prior to or after transfer with an alkaline material or exposed to ammonia vapors after tranfer to produce image development. Transfer can be effectuated with the help of a solvent or solvent mixture which swells or partially dissolves the plastic pigment, or with heat if the carrier base has sufficient release properties for the coating layer. The role of the plastic pigment as a matrix for the diazotype components is obvious because no transfer takes place under the same conditions from diazotype coating layers which are otherwise identical except for the omission of the plastic pigment.

It has also been found that the spherically shaped plastic pigment particles of the invention herein when used as an undercoat prior to the sensitizing of the base sheet or when admixed with the diazo sensitizing solution easily spread on the base sheet using conventional aqueous diazotype coating machines. Also, even with increased coating weights the layer of the invention dries rapidly when using the conventional equipment. In this connection, it has been found that no difficulties are encountered when applying the spherically shaped pigment particles either to a heavy weight base sheet or to a standard weight base sheet of 75 grams per square meter, or to a light weight base sheet of 50 grams per square meter. Such diazotype reproduction materials having similar characteristics as noted above have only been available on special baryta coated base papers. Such baryta coated base papers have baryta coatings of about 30 grams per square meter or more and require base paper weights of at least 110 grams per square meter. Such bartya coated papers also require special coating and drying equipment.

When employing this invention it has been found that the coating composition of this invention when applied on each side of the base sheet permits the use of diazo sensitizing solutions on each side thereby obtaining diazo reproductions on each side of the base sheet of a standard weight base paper. Heretofore, however, satisfactory results could only be obtained with heavier weight base papers. The coating composition of this invention with the spherically shaped pigment particles substantially reduces the ultraviolet light transmission through the coated sheet thereby obviating the necessity of using special base paper.

It has further been found that the matrix formed by the spherically shaped pigment particles of this invention has the ability to accommodate substantial concentrations of components throughout the matrix in addition to dispersing the conventional diazo sensitizing components. Such components can be development aids such as urea which when heated releases ammonia which aids in the development of the sensitized layer. It is believed that the improved development is obtained through the thermoplastic character of the plastic pigments which frit and melt when heated and make the layer less pervious to the generated ammonia vapors which thus do not escape; otherwise they are lost for the development reaction.

In one aspect of this invention noted above it has been found that diazotype reproduction materials when coated with the spherically shaped plastic pigment particles of this invention form a layer on a base sheet which can be resensitized many times thereby allowing overprinting which results in a multi-color print on a single base sheet. To prepare the diazo reproduction sheet of this invention for multi-color use it is necessary to apply a solvent treatment to the matrix which converts the surface of the diazo reproduction material from one that is water wettable to one that is not water receptive. After the first printing and development a second application of the diazo matrix sensitizing composition is applied to the already developed print surface and spreads uniformly thereover without attacking or bleeding out the developed primary image. The solvent treatment is repeated and the material is ready for a second printing and development. The foregoing process can be repeated as many times as is necessary to achieve the number of colors required for the multicolor print.

The spherically shaped plastic pigment particles of this invention are basically polystyrene pigments. The particle size of the polystyrene may be in the range of from 0.15 to about 0.7 microns and preferably from about 0.2 to 0.5 microns. The polystyrene pigment is applied to the base sheet in a quantity of from about 4 gms. to about 10 gms. per square meter. Preferably the application is within the range of from about 5 gms. to about 7.5 gms.

It has been found that by modifying the matrix material of this invention various changes in characteristics of the resulting diazotype reproduction material can be achieved. For performance modifications such as changes of the shape of the sensitometric curve of the diazotype reproduction material, water sensitivity of the surface, thermoplastic characteristics of the diazotype layer, surface smoothness and surface hardness, pencil receptivity, erasability, surface friction characteristics, other resin dispersions such as vinyl acetate, vinyl chloride, vinylidene chloride, acrylic, styrene, styrene-butadiene, ethylene-polymers or copolymers or natural or synthetic hydrophilic colloids, uncooked starch particles or mineral pigments or organic plasticizers may be admixed. Many of the above named components are compatible with the above cited commercial polystyrene latex particles. However, some require the addition of dispersing or wetting agents to prevent flocculation. In this connection the modification of the diazo sensitizing solution may require the addition of a minor amount of wetting or dispersing agents to prevent flocculation of the polystyrene resin latex of this invention.

DESCRIPTION OF THE DRAWINGS

The following graphs depicted in FIGS. 1–9 show the sensitometric curves obtained by sensitometrically analyzing the diazo prints obtained from diazo reproduction materials made in accordance with this invention.

Figures 1, 2, 3:
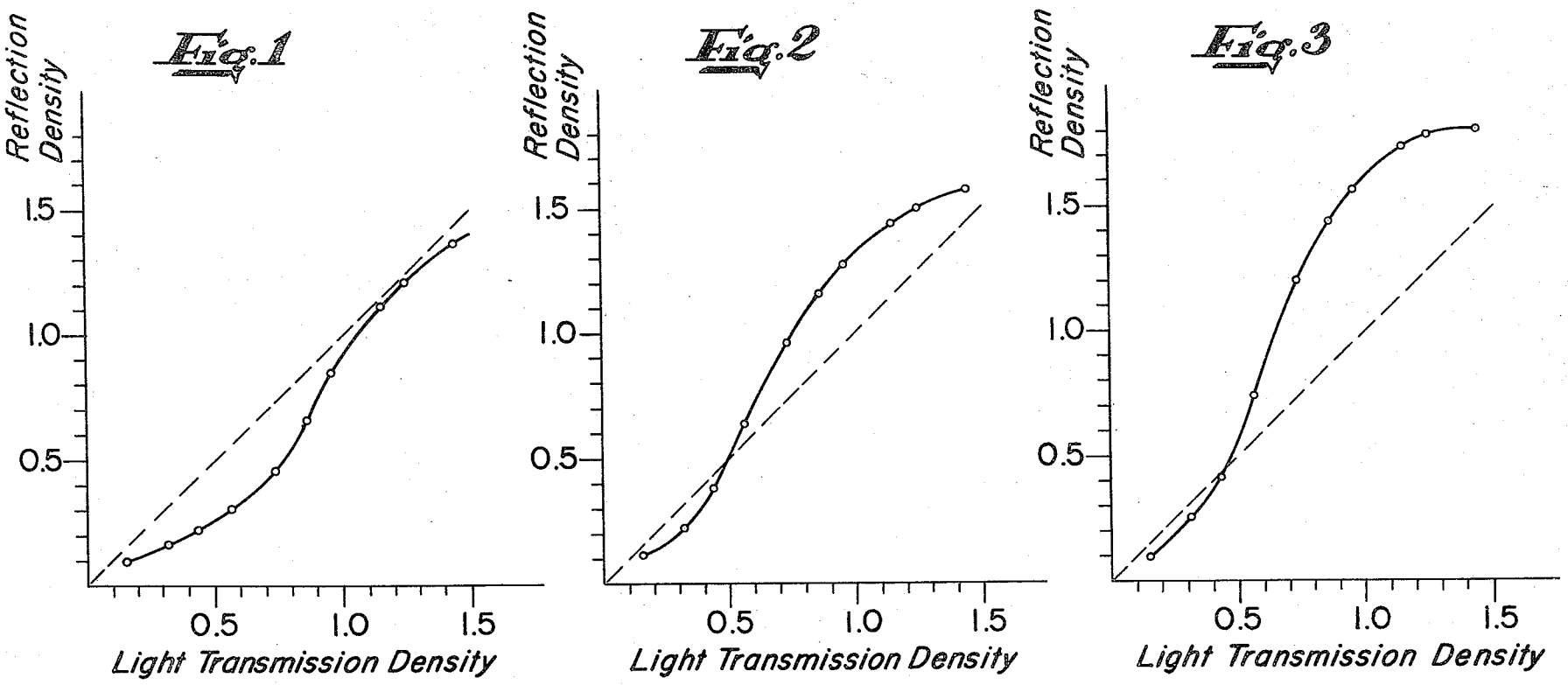
FIG. 1–7 represent the sensitometric curves obtained from the diazo prints obtained by the procedures of Examples 1 and 2.

The following examples are illustrative of forming a diazo reproduction material and a diazo print in accordance with the invention herein. It should be understood, however, the examples are for illustrative purposes only.

EXAMPLE 1

On a diazotype coating machine, equipped with three airknife coating stations for precoating, sensitizing and back coating, and with high velocity hot air convection dryers after each coating station, a 100% sulfite diazo base paper of 75 g/m² basis weight was treated in sequence on the three coating stations at a coating speed of 3,500 yds/hr with the following preparations;

1. Base coat (applied on he precoat station):

The following products were mixed under slight mechanical stirring:

| | |
|---|---|
| Water | 3,500 ml |
| Ammonia (25%) | 60 ml |
| Spherical particles of polystyrene pigment dispersion (LYTRON RX 1259 Monsanto Tradename) | 5,600 ml |
| Vinylacetate copolymer | 600 ml |
| Antifoaming agent | 2 ml |

The coat contains 6.5 gms. of polystyrene pigment per square meter of base paper.

2. Diazo Sensitizing Solution (applied on sensitizing station): The solution was prepared by dissolving the following products under mechanical stirring:

| | |
|---|---|
| Citric acid | 150 g |
| Caffeine | 100 g |
| Thiourea | 500 g |
| Coupler 0 * (2,7-dihydroxynaphthalene-3,6-disulfonic acid disodium salt) | 150 g |
| Coupler No. 910 ** | 110 g |
| Isopropanol | 100 ml |
| Diresorcinol sulfide | 7 g |
| Diazo No. 48 *** (1-diazo-4-N,N-dimethyl aniline stabilized with one-half mole of zinc chloride) | 250 g |
| Sodium chloride | 100 g |
| Zinc chloride | 250 g |
| Saponin | 3 g |
| Alizarine Irisol | 2 g |
| Vinylacetate polymer dispersion | 100 ml |

-continued

| | |
|---|---|
| Water, enough to make | 10,000 ml |

The solution was completely accommodated by the base coat (1) which thereby formed the matrix for the diazotype components.

3. Backcoat solution (applied on the backcoat station):

The solution was prepared by mixing:

| | |
|---|---|
| Water | 8,000 ml |
| Vinylacetate copolymer | 4,000 ml |
| Antifoaming agent | 2 ml |

After these three treatments the paper was wound up in a conventional manner and was ready for converting into sheets of commercial sizes.

The paper was used to make contact copies from continuous tone silver films in a commercial diazotype copying machine. Prints were obtained that were rich in tonal reproductions of the light, medium and deep density values of the original. The paper has a wide latitude for different printing speeds without losing details of the original.

When the procedure for preparing the diazotype paper of Example No. 1 was repeated with the exception that in the base coat (1) the LYTRON RX 1259 was replaced by the same amount of a polystyrene latex of a particle size of 0.05 micron, a diazotype material was obtained with a conventional diazotype sensitometric behaviour. Prints made with this material from continuous tone silver film masters reproduced well the details in the medium density range of the master but the light density range of the original was bleached out and the deep density range showed no differentiations of density differences. The paper has no latitude for different printing speeds.

A diazotype paper having similarly no latitude for printing speeds was obtained by omitting base coat (1) entirely or replacing it with a conventional non-colloidal silica precoat containing 5% non-colloidal silica and 7.5% polyvinyl acetate latex.

A line drawing was prepared on a commercial "Clearprint" tracing paper by using a pencil of 4H hardness. Some of the lines on the drawing for stressing important features of the drawing were overdrawn with the black India ink. Diazotype copies were made from this original on a commercial diazotype copying machine with diazotype paper from Example No. 1 at different printing speeds. Considering the optimum printing speed as the one which results in a print that shows the greatest contrast between the reproduction of the India ink lines, the 4H pencil lines and a uniform light grey print background, this printing speed could be varied by plus or minus 33% without losing the desirable visual contrast for easily differentiating between the reproductions of the India ink lines and the 4H pencil lines above a uniform print background.

When the same original was used to make copies in a corresponding manner with diazotype paper which was identically prepared as the one from Example No. 1 except that the base coat (1) was replaced by a conventional non-colloidal silica precoat containing 5% non-colloidal silica and 7.5% polyvinylacetate latex as a binder, the printing speed latitude around the optimum printing speed of this diazotype paper was plus or minus 8%. In all these prints however there was less contrast between the India ink lines and the 4H pencil line reproductions, and the 4H pencil reproduction lines were less continuous than on the copies made on the Example No. 1 diazotype paper.

* *** Supplied by Andrews Paper & Chemical Company
** Tradename of Andrews Paper for Trihydroxydiphenyl

EXAMPLE 2

Sample sheets according to Example No. 1 which contained the base coating (1), the diazo coating (2), and the backcoating (3) were processed in the following different ways (A) through (F) resulting in diazotypes with different characteristics.

The sensitometric curves were established by exposing the diazotype sheets to a high pressure mercury lamp in a commercial diazotype copying machine "OZAMATIC" behind a Kodak Projection Print Scale with 10 different transmission density steps.

| Step No. | Transmission Density |
|---|---|
| 2 | 1.44 |
| 3 | 1.25 |
| 4 | 1.16 |
| 6 | 0.96 |
| 8 | 0.87 |
| 12 | 0.73 |
| 16 | 0.57 |
| 24 | 0.43 |
| 32 | 0.32 |
| 48 | 0.15 |

The reflection density of the diazotype prints after development with ammonia vapors were measured for each step of the reproduced print scale and the reflection density values on the Y axis were plotted against the transmission density values on the X axis in the FIGS. 1 through 7.

A dotted line is traced in each figure at an angle of 45°, which angle corresponds to a sensitometric gamma of 1. The object of inserting the gamma 1 line is for visual comparative purposes only.

A. A sheet of the sample material was exposed behind a Kodak Projection Print Scale in a commercial diazotype copying machine at a speed that after development sector 48 was completely bleached out, sector 32 showed a very light grey and the other sectors showed increasing grey black reflection density values. The reflection densities of all sectors were measured and plotted against the transmission densities of the Kodak Projection Print Scale and entered in FIG. 1.

B. Another sheet of the sample material was treated with an excess of OMS (odorless mineral spirit) and the excess of OMS was removed with a paper towel. The sheet was then printed and developed after evaporation of the OMS and evaluated in the same manner as described under A above. The data were plotted and are illustrated in FIG. 2.

C. Another sheet of the sample material was printed in the same manner as under A above and then exposed to an infrared heat radiator until the print surface started to frit and become slightly more glossy in appearance. The print was then sensitometrically evaluated and the data were plotted as illustrated in FIG. 3.

Figures 4, 5, 6:
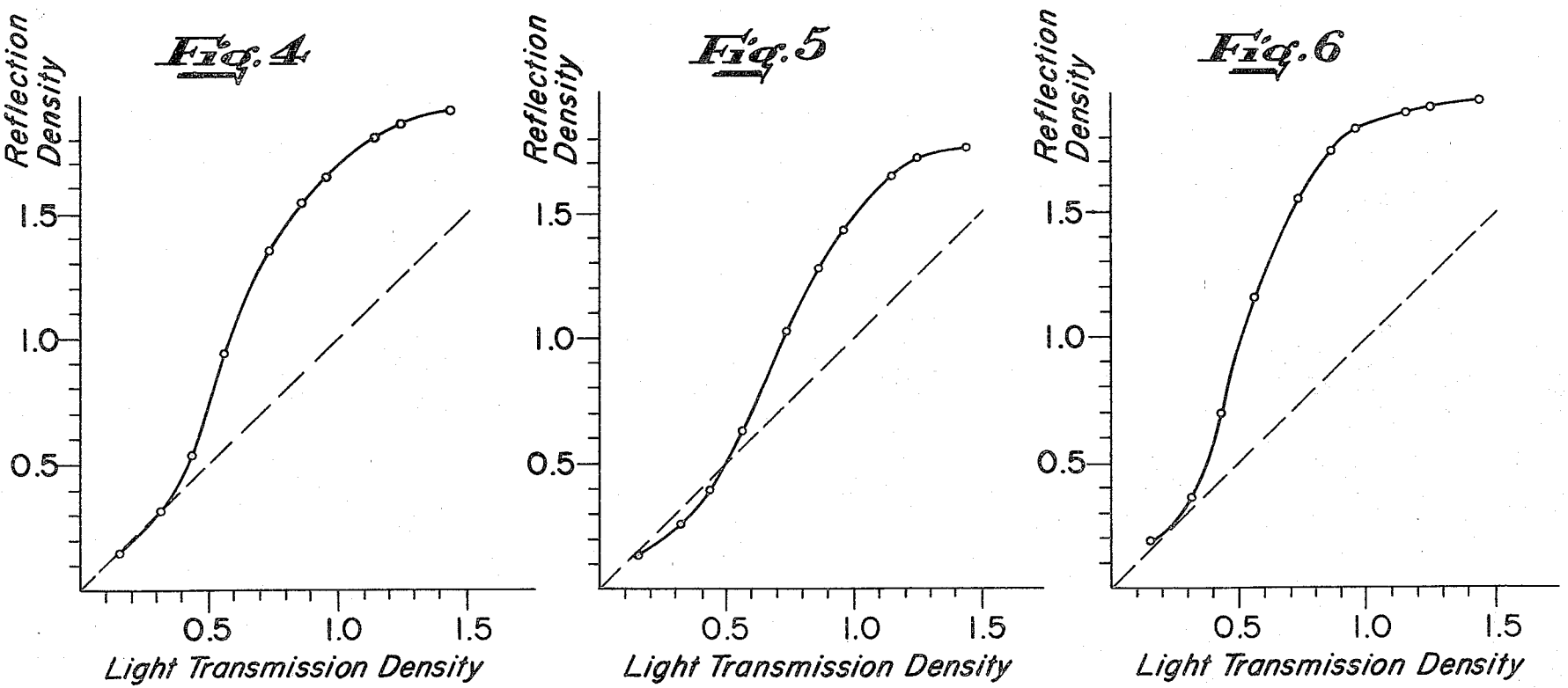

D. Another sheet of the sample material was printed in the same manner as under A above and then brushed over with a solvent mixture of 65% toluene and 35% OMS (odorless mineral spirit), dried, sensitometrically evaluated, and the data plotted as illustrated in FIG. 4.

E. Another sheet of the same sample material was brushed over with toluene, then dried, and thereupon printed in the same manner as under A above and sensitometrically evaluated. The data were plotted as illustrated in FIG. 5.

F. Another sheet of the sample material was exposed to heat until the print surface started to frit and became somewhat glossy in appearance. The sheet was then printed and sensitometrically evaluated. The data were plotted as illustrated in FIG. 6.

Figures 7, 8, 9:
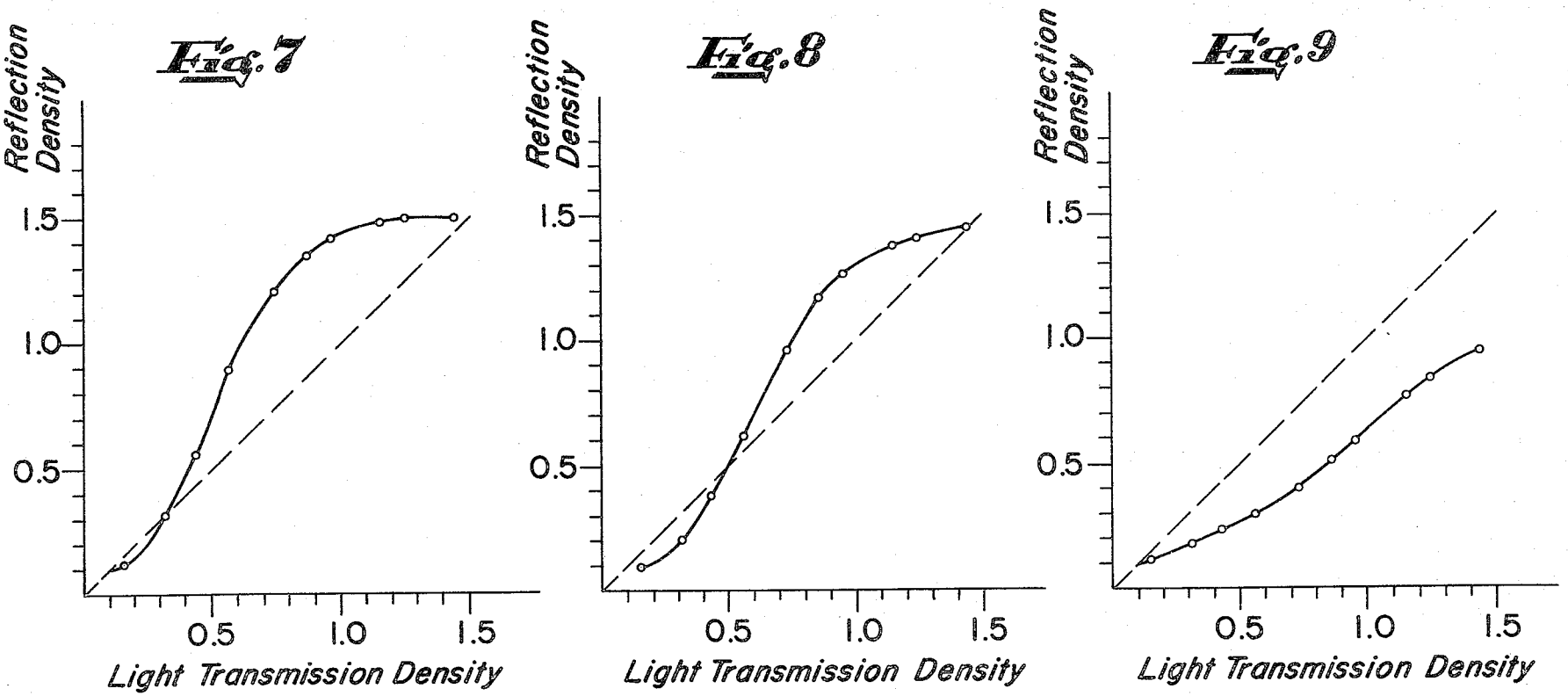
FIG. 8 represents the sensitometric curve from the diazo obtained from the procedure of Example 5.
FIG. 9 represents the sensitometric curve from the diazo print obtained from the procedure of Example 7.

When the procedures from A through F above were repeated with diazotype materials otherwise identical as above except that the base coat (1) was replaced by a conventional non-colloidal silica precoat, the sensitometric curves of all prints were hardly different from each other and were very close to the curve of FIG. 7. The heat treatments of C and F above had no affect on the appearance of the print surface nor on the form of the sensitometric curve.

EXAMPLE 3

A diazo sensitized and solvent treated sheet in accordance with Example No. 1 was used to prepare a four color copy from a poster containing image information in four colors: black, blue, yellow and red.

Four individual silver photographic separations on positive film of the original, one for each color, were prepared in a conventional manner.

The silver master for the black image part was brought in contact with the above sensitized diazo paper and its position marked for registering purposes. The sandwich was then exposed in a commercial diazotype machine and developed with ammonia vapors. A copy of the master was obtained with deep black lines on a white background.

The print side was then overcoated with the help of a wire rod for even distribution with the following coating composition:

| | |
|---|---|
| Non ionic wetter | 1 ml |
| Spherical particles of polystyrene pigment dispersion (LYTRON RX 1259 Monsanto Tradename) | 50 ml |
| Water | 50 ml |
| Citric acid | 2 g |
| Coupler No. 144 * (2-hydroxy-3-n-propylmorpholino amido naphthoic acid) | 1.5 g |
| Caffeine | 1 g |
| Diazo No. 56 ** (1-diazo-2,5-diethoxy-4-morpholino benzene stabilized with one-half mole zinc chloride) | 2 g |
| Thiourea | 2 g |
| Zinc chloride | 2 g |

After drying at moderate heat under subdued light the surface was brushed over lightly with a mixture of:

| | |
|---|---|
| Toluene | 65 ml |
| OMS (odorless mineral spirit) | 35 ml |

This resensitized sheet was sandwiched and registered with the silver master for the blue image part and then exposed in a commercial diazotype printer and developed with ammonia vapors. A copy was obtained with the original blackline information from the first master and the information from the second master in deep blue lines on a white background.

The print was resensitized again in an identical manner as before except for the composition of the sensitizing solution which was composed as follows:

| | |
|---|---|
| Non ionic wetter | 1 ml |
| Spherical particles of polystyrene pigment dispersion (LYTRON RX 1259 Monsanto Tradename) | 50 ml |
| Water | 50 ml |
| Citric acid | 1 g |
| Coupler No. 670 *** | 2 g |
| Diazo No. 49 **** (1-diazo-4-N,N-diethyl aniline stabilized with one-half mole zinc chloride) | 1 g |
| Thiourea | 2 g |
| Zinc chloride | 2 g |

and after drying solvent treated with the same composition and in the same manner as before and dried.

The newly sensitized sheet was sandwiched and registered with the silver master of the yellow image part and then exposed in a commercial diazotype printer and developed with ammonia vapors. A copy was obtained which contained the information of the third master in strong yellow lines besides the information of the earlier 2 masters in black and blue color on a white background.

The resensitizing of the print surfaces was repeated in an identical manner except that the following sensitizing solution was used:

| | |
|---|---|
| Non ionic wetter | 1 ml |
| Spherical particles of polystyrene pigment dispersion (LYTRON RX 1259 Monsanto Tradename) | 50 ml |
| Water | 50 ml |
| Sulfuric acid (conc.) | 1 ml |
| Coupler PHMP ***** | 1 g |
| Diazo No. 49 **** supra | 1 g |
| Thiourea | 2 g |
| Zinc chloride | 2 g |

and after drying the surface was solvent treated with the same composition and in the same manner as before and dried.

The again resensitized sheet was sandwiched and registered with the silver master for the red image portion and then exposed in a commercial diazotype printing machine and developed with ammonia vapors. A copy was obtained which contained the information of the 4th master in bright red color besides the information of the earlier 3 masters in black, blue and yellow colors on a white background.

When the identical procedUre of Example No. 3 was used but without the LYTRON RX 1259, each overcoating leached out most of the print image of the preceding coating layer.

*  * ***** Supplied by Andrews Paper & Chemical Company
*** Trade name of Andrews Paper for Cyanoacetmorpholide

EXAMPLE 4

On a diazotype coating machine, equipped with three airknife coating stations for precoating, sensitizing and back coating, and with high velocity hot air convection dryers after each coating station, a pretransparentized 100% rag base paper of 60 g/m² basis weight was treated in sequence on the three coating stations at a coating speed of 3,000 yds/hr with the following preparations:

1. Base coat (applied on the precoat station): The following products were mixed under slight mechanical stirring:

| | |
|---|---|
| Water | 3,500 ml |
| Ammonia (25%) | 60 ml |
| Spherical particles of polystyrene pigment dispersion (LYTRON RX 1259 Monsanto Tradename) | 5,600 ml |
| Vinylacetate copolymer | 450 ml |
| Antifoaming agent | 2 g |

The applied coat contains 7.1 gms. of polystyrene pigment per square meter of base paper.

2. Diazo Sensitizing Solution (applied on sensitizing station): The solution was prepared by dissolving the following products under mechanical stirring:

| | |
|---|---|
| Non colloidal silica | 100 g |
| Antifoaming agent | 20 g |
| Citric acid | 250 g |
| Boric acid | 100 g |
| Caffeine | 50 g |
| Diazo No. 48 * (see Example 1 supra) | 475 g |
| Isopropanol | 100 ml |
| Coupler RG ** | 40 g |
| Coupler RX *** | 300 g |
| Thiourea | 150 g |
| Sodium chloride | 150 g |
| Zinc chloride | 100 g |
| Saponin | 10 g |
| Vinylacetate polymer dispersion | 300 ml |
| Water, enough to make | 10,000 ml |

The solution was completely accommodated by the base coat (1) which thereby formed the matrix for the diazotype components.

3. Backcoat Solution (applied on the backcoat station): The solution was prepared by dissolving:

| | |
|---|---|
| Water | 10,000 ml |
| Citric acid | 50 g |

After these three treatments, the paper was wound up in conventional manner and the finished roll was transferred to a conventional transparentizing machine consisting of an unwind stand, a kiss roller applicator with ensuing mechanical scraper bar, a low velocity hot air convection dryer and wind up station. The roll was mounted on the unwind stand so that the diazo sensitized surface of the web passing through the machine faced the applicator roller.

The above treated paper was coated in this machine with the following solution:

| | |
|---|---|
| Toluene | 8,500 ml |
| OMS (odorless mineral spirit) | 3,500 ml |
| Paraffin oil | 200 ml |

After drying, the sensitized side had a rather glossy appearance. A sample of the paper was exposed behind a Kodak Projection Print Scale in a commercial diazotype copying machine and developed with ammonia vapors in the same machine. A deep brown print of high contrast on a translucent base was obtained. The print was entirely unaffected by water which ran off from the print surface. The brown print dye coverage of the print was very even in full tones as well as in the intermediate tones.

The print was used to make reprints on standard speed opaque blackline diazotype paper. Excellent blackline copies were obtained.

When the procedure of Example No. 4 was repeated with the exception that the base coat (1) composition was replaced by a conventional non-colloidal silica precoat containing 5% non-colloidal silica and 7.5% polyvinylacetate dispersion an intermediate diazotype was obtained which was wettable and the brown dyeline bled off. The print dye coverage was less uniform in full tones and in intermediate tones and the print contrast was substantially lower. The reprint translucency was less and the reprint opacity was also lower.

* Supplied by Andrews Paper & Chemical Company
** Coupler RG - Alpha Resorcylicacidethanolamide
*** Coupler RX - Beta Resorcylicacidethanolamide

EXAMPLE 5

On a diazotype coating machine, equipped with three airknife coating stations for precoating, sensitizing and backcoating, and with a high velocity hot air convection dryer after each coating station, a 100% sulfite diazo base paper of 75 g/m$^2$ basis weight was treated in sequence on the three coating stations at a coating speed of 3,500 yds/hr with the following preparations:

1. Base coat (applied on the precoat station): The following products were mixed under slight mechanical stirring:

| | |
|---|---|
| Water | 3,500 ml |
| Ammonia (25%) | 60 ml |
| White dextrine | 400 g |
| Spherical particles of polystyrene pigment dispersion (LYTRON RX 1259 Monsanto Tradename) | 4,800 ml |
| Vinylacetate | 1,000 ml |
| Antifoaming agent | 2 g |

The coat contains 7.4 gms of polysytrene pigment per square meter of base paper.

2. Diazo Sensitizing Solution (applied on sensitizing station): The solution was prepared by dissolving the following products under mechanical stirring:

| | |
|---|---|
| Citric acid | 150 g |
| Caffeine | 100 g |
| Thiourea | 500 g |
| Coupler 0 * (see Example 1 supra) | 150 g |
| Coupler No. 910 ** | 110 g |
| Isopropanol | 100 ml |
| Diresorcinol sulfide | 7 g |
| Diazo No. 48 *** (see Example 1 supra) | 250 g |
| Sodium chloride | 100 g |
| Zinc chloride | 250 g |
| Saponin | 3 g |
| Alizarine Irisol | 2 g |
| Vinylacetate polymer dispersion | 100 ml |
| Water, enough to make | 10,000 ml |

The solution was completely accommodated by the base coat (1) which thereby formed the matrix for the diazotype components.

3. Backcoat Solution (applied on the backcoat station): The solution was prepared by mixing:

| | |
|---|---|
| Water | 6,000 ml |
| Vinylacetate copolymer | 4,000 ml |
| Antifoaming agent | 2 ml |

After these three treatments the paper was wound in a conventional manner and was ready for converting into sheets of commercial size.

This diazotype paper was sensitometrically evaluated and its curve is shown in FIG. 8. The sensitometric curve follows a path in between that of the treated paper made in accordance with Example No. 1 and a standard diazotype coating illustrated in FIG. 7.

* *** Supplied by Andrews Paper & Chemical Company
** Tradename of Andrews Paper for Trihydroxydiphenyl

EXAMPLE 6

A diazo base paper was coated in the same manner as in Example No. 1 with the exception of the (1) base coat which was changed to have the following composition:

| | |
|---|---|
| Water | 3,500 ml |
| Ammonia | 60 ml |
| Pigment XD 7226.00 (Tradename of Dow Chem. Co. for 0.5 micron spherical particle size polystyrene dispersion) | 5,600 ml |
| Vinylacetate copolymer dispersion | 450 ml |
| Antifoaming agent | 2 g |

The coat contains 9.8 gms. of pigment per square meter of base paper.

In the printing evaluation this diazotype paper essentially performed identical to the product of Example No. 1.

EXAMPLE 7

A diazo base paper was coated in the same manner as in Example No. 1 with the exception of the (1) base coat which was changed to have the following compositions:

| | |
|---|---|
| Water | 3,500 ml |
| Ammonia (25%) | 60 ml |
| LYTRON RX 1672 (Tradename of Monsanto for 0.2 micron spherical particle size polystyrene dispersion) | 5,600 ml |
| Vinylacetate copolymer | 600 ml |
| Antifoaming agent | 2 ml |

The coat contains 6.3 gms. of polystyrene per square meter of base paper.

The sensitometric evaluation of this diazotype paper showed a very soft gradation with very little flattening out at the top end of the curve which is otherwise typical for diazotypes. The low contrast toe zone reaches far into the higher density ranges as can be seen in FIG. 9.

A finished roll of sensitized paper was transferred to a conventional transparentizing machine consisting of an unwind stand, a kiss coating roller applicator with ensuing mechanical scraper bar, a low velocity hot air convection dryer and wind up station. The following solution was applied to the sensitized side of the paper:

| | |
|---|---|
| Toluene | 6,500 ml |
| OMS (odorless mineral spirit) | 3,500 ml |
| Paraffin oil | 200 ml |

After drying, the treated surface of the paper took a rather glossy appearance and had become water repellent. The sensitometric evaluation of this diazotype paper showed a very steep gradation.

EXAMPLE 8

On a diazotype coating machine, equipped with 2 airknife coating stations, one for each side of the web to be treated, and a conventional low velocity convection air heater, a 100% sulfite diazo base paper of a basis weight of 80 g/m$^2$ was treated on the 2 coating stations in sequence at a speed of 2,500 yds/hr with the following preparations:

1. Coating compositions for the felt side of the paper:

| | |
|---|---|
| Water | 3,500 ml |
| Sulfamic acid | 20 g |
| Caffeine | 125 g |
| Diazo No. 54 S * (1-diazo-2,5-dibutoxy-4-morpholino benzene sulfate, 80% strength) | 175 g |
| Methylviolet | 0.25 g |
| Ammonium oxalate | 35 g |
| Aluminum sulfate | 35 g |
| White dextrine | 600 g |
| Spherical particles of polystyrene pigment dispersion (LYTRON RX 1259 Monsanto Tradename | 1,800 ml |
| Non ionic wetter | 15 g |
| Antifoaming agent | 40 g |

2. Coating composition for the wire side of the paper:

| | |
|---|---|
| Water | 9,000 ml |
| White dextrine | 1,000 g |
| Citric acid | 50 g |

After the application of each coating the paper was dried.

A non-curly diazotype paper resulted which was exposed behind a film master in a commercial diazotype printing machine and then developed in a commercial diazotype developing machine for the moist developing process with a commercial alkaline phloroglucinol developer solution.

A diazotype print with deep blacklines in full tones and with even coverage in intermediate tones on a white background was obtained.

When the identical procedure was used for the preparation of the diazotype paper but without the LYTRON RX 1259, a print was obtained with much flatter full tones and with a coarse grain in the intermediate tones.

* Supplied by Andrews Paper & Chemical Company

EXAMPLE 9

On a diazotype coating machine, equipped with 2 airknife coating stations, one for each side of the web to be treated, and a high velocity hot air convection dryer, a pretransparentized 100% rag paper base of 60 g/m$^2$ basis weight was treated in sequence at a speed of 2,500 yds/hr with the following preparations:

1. Coating composition for the front side of the paper:

| | |
|---|---|
| Citric acid | 250 g |
| Sulfuric acid (conc.) | 50 ml |
| Diazo No. 48 * (see Example 1 supra) | 500 g |
| Coupler RX ** | 150 g |
| Coupler No. 690 *** | 200 g |
| Coupler RG **** | 75 g |
| Isopropanol | 100 ml |
| Thiourea | 150 g |
| Zinc chloride | 150 g |
| Antifoaming agent | 50 g |
| Polyvinylalcohol | 100 g |
| Non ionic wetting agent | 150 g |
| LYTRON RX 1259 (Monsanto trade name for 0.5 micron spherical particle size polystyrene) | 3,500 ml |
| Water, enough to make a total volume of | 10 liters |

2. Coating composition for the back side of the paper:

| | |
|---|---|
| Water | 6,000 ml |
| Dextrine | 300 g |
| Polyvinylacetate | 4,000 ml |

After these two treatments the paper was wound up in a conventional manner and then converted into customer sized sheets. The thus obtained intermediate diazotype paper had a smooth surface, was completely dry to the touch and very resistant to rubbing.

The performance of the paper was tested in a commercial diazotype printing machine. One sheet was processed in the developing section of the machine without exposing it to light. A strong brown colored print with excellent coverage was obtained. The sheet easily processed through the machine without sticking or slipping and the coating did not smear off when manipulated. Another sheet was used to make a copy from a pencil drawing tracing sheet original. A print with strong brown lines on a white translucent background was obtained. This print was then used as a second original to make further copies on opaque blackline diazo paper. The second original exhibited excellent reprint opacity lines and high quality copies were obtained.

When the same performance tests were repeated with a diazotype intermediate paper which was prepared identically to the one of this example except that in coating (1) the LYTRON RX 1259 was omitted and replaced by colloidal silica at a practically feasible concentration of 250 g in 10 liters coating solution, this paper had a somewhat chalky surface with low resistance to rubbing and the surface became smeary when being processed in the developer section of the copying machine. The reprint opacity of the dyeline was inferior.

* Supplied by Andrews Paper & Chemical Company
** Coupler RX - Beta Resorcylicacidethanolamide
*** Coupler No. 690 - Dicyanoacet triethylenetetramine hydrochloric acid salt
**** Coupler RG - Alpha Resorcylicacidethanolamide

EXAMPLE 10

On a diazotype coating machine equipped with 2 airknife coating stations, one for each side of the web to be treated, and a high velocity hot air convection dryer, a natural transparent 100% sulfite base paper of 80 g/m² basis weight, such as manufactured and sold under the name of Transparent-papier by Gebr. Hoesch of Germany, was treated in sequence at a speed of 2,000 yds/hr with the following preparations:

1. Coating composition for the front side of the paper:

| | |
|---|---|
| Citric acid | 250 g |
| Boric acid | 100 g |
| Caffeine | 50 g |
| Diazo No. 88 * (1-diazo-3-methyl-4-pyrrolidino benzene chloride stabilized with zinc chloride) | 500 g |
| Coupler RX ** | 250 g |
| Coupler RG *** | 45 g |
| Coupler No. 670 **** | 100 g |
| Isopropanol | 100 ml |
| Thiourea | 300 g |
| Urea | 300 g |
| Sodium chloride | 150 g |
| Non ionic wetting agent | 250 g |
| Spherical particles polystyrene pigment dispersion (LYTRON RX 1259 Monsanto Tradename) | 1,500 ml |
| Polyvinylacetate dispersion | 1,500 ml |
| Antifoaming agent | 25 g |
| Water, enough to make a total volume of | 10 liters |

2. Coating composition for the backside of the paper:

| | |
|---|---|
| Water | 8 liters |
| Urea | 400 g |
| Polyvinylacetate dispersion | 2 liters |

After these two treatments the paper was wound up in a conventional manner and then converted into customer size sheets.

A high quality diazotype intermediate paper for ammonia development was obtained which printed and developed to strong brown dyelines on a clean background.

The paper was used to make a copy from a pencil tracing and the obtained copy was used as a second original to make further copies on a blackline opaque diazotype paper. Blackline copies of excellent contrast were obtained.

When the same performance tests were repeated on a diazotype intermediate paper which was made from the same base and the same sensitizing solution except for omitting the LYTRON RX 1259, flat looking diazotype intermediate prints were obtained and when used as second originals to make further copies with the blackline opaque diazotype paper, copies were obtained with dyelines having substantially less line density than the ones from the intermediate diazotypes of Example No. 10.

* Supplied by Andrews Paper & Chemical Company
** Coupler RX - Beta Resorcylicacidethanolamide
*** Coupler RG - Alpha Resorcylicacidethanolamide
**** Coupler No. 670 - Trade name of Andrews Paper Company for Cyanoacetmorpholide

EXAMPLE 11

On a diazotype coating machine, equipped with 3 airknife coating stations for precoating, sensitizing, and back coating, and with high velocity hot air convection dryers after each coating station, a 100% sulfite diazo base paper of 75 g/m² basis weight was treated in sequence on the three coating stations at a coating speed of 3,000 yds/hr with the following preparations:

1. Base Coat (applied on the precoat station): The following products were mixed under slight stirring:

| | |
|---|---|
| Water | 3,500 ml |
| Ammonia (25%) | 60 ml |
| Spherical particles polystyrene pigment dispersion (LYTRON RX 1259 Monsanto Tradename) | 5,600 ml |
| Vinylacetate copolymer dispersion | 600 ml |
| Urea | 1,000 g |
| Antifoaming agent | 2 ml |

The coat contains 6.8 gms of pigment per square meter of base sheet.

2. Diazo Sensitizing Solution (applied on sensitizing station): The solution was prepared by dissolving the following products under mechanical stirring:

| | |
|---|---|
| Sulfuric acid (conc.) | 60 ml |
| Coupler No. 111 * (2,3-dihydroxy-naphthalene-6-sulfonic acid sodium salt) | 200 ml |
| Thiourea | 300 g |
| Diazo No. 88 ** (see Example 10 supra) | 150 g |
| Urea | 700 g |
| Zinc chloride | 200 g |
| Water, enough to make | 10,000 ml |

3. Backcoat Solution (applied on the backcoat station): The solution was prepared by mixing:

| | |
|---|---|
| Water | 8,000 ml |
| Vinylacetate polymer dispersion | 2,000 ml |

After these three treatments the paper was wound up in a conventional manner and converted into sheets of commercial size.

A sensitized sheet was exposed in a commercial diazotype copying machine behind a translucent master with a pencil drawing in a conventional manner, to the ultraviolet light of the mercury tube. The exposed sheet was then passed through a diazotype heat developing machine. A copy of the original drawing with strong blue lines on a white background resulted.

When the exposure and developing steps were repeated with a diazotype paper which was prepared identically to the material of Example No. 11 but with the omission of the base coat (1), a print was obtained with substantially weaker lines.

* ** Supplied by Andrews Paper & Chemical Company

EXAMPLE 12

On a diazotype coating machine equipped with 3 airknife coating stations for precoating, sensitizing, and backcoating and with high velocity hot air convection dryers after each coating station, a 100% sulfite diazo base paper of 75 g/m² basis weight was treated in sequence on the three coating stations at a coating speed of 3,500 yds/hr with the following preparations:

1. Base coat (applied on the precoat station): The following products were mixed under slight mechanical stirring:

| | |
|---|---|
| Water | 3,500 ml |
| Ammonia (25%) | 60 ml |
| Spherical particles polystyrene pigment dispersion (LYTRON RX 1259, Monsanto Tradename) | 5,600 ml |
| Vinylacetate copolymer | 600 ml |
| Antifoaming agent | 2 ml |

The coat contains 6.8 gms of pigment per square meter of base sheet.

2. Diazo Sensitizing Solution (applied on sensitizing station): The solution was prepared by dissolving the following products under mechanical stirring:

| | |
|---|---|
| Citric acid | 200 g |
| Caffeine | 100 g |
| Thiourea | 300 g |
| Coupler No. 111 * (see Example 11 supra) | 200 g |
| Diazo No. 88 ** (see Example 10 supra) | 150 g |
| Saponin | 2 g |
| Zinc chloride | 400 g |
| Vinylacetate polymer dispersion | 100 ml |
| Water, enough to make | 10,000 ml |

3. Backcoat Solution (applied on backcoat station): The solution was prepared by mixing:

| | |
|---|---|
| Water | 8,000 ml |
| Vinylacetate polymer | 2,000 ml |
| Antifoaming agent | 2 ml |

After these three treatments the paper was wound in a conventional manner and was ready for converting into sheets of commercial sizes.

A sheet of the paper was used to make a contact copy on a commercial diazotype copying machine from an architectural rendering of a building on a translucent tracing paper. The picture side of the tracing was placed in contact with the diazo coated side of the diazotype paper for processing the sandwich through the printing section of the copying machine. After development with ammonia a strong blue mirror image of the original on a white background was obtained.

A sheet of white bond paper of the same size as the copy was imbibed with xylene and then brought in contact with and pressed against the blue mirror image copy. While still wet the two sheets were separated and a true transfer copy in blue color of the original was obtained.

When an identical copy of the architectural rendering was made on a diazotype paper which had been prepared identically as the one of Example No. 12 with the exception of omitting the base coat (1), and when the obtained blueline copy was brought in contact with and pressed against a bond paper sheet imbibed with xylene, no transfer took place.

* ** Supplied by Andrews Paper & Chemical Company

EXAMPLE 13

A sheet of sensitized paper from Example No. 4 with the three coatings (1) Base Coat, (2) Sensitizing, and (3) Backcoat, but without solvent treatment was used for the following transfer development process:

The sheet was exposed to the printing light of a commercial diazotype copying machine through a technical drawing on a translucent tracing sheet in a manner that the picture side of the original was in direct contact with the diazo coated side of the test sheet.

After exposure to light the test sheet was brought in contact with and pressed against a white bond paper sheet which had been imbibed previously with a mixture of:

| | |
|---|---|
| Toluene | 700 ml |
| Ethanol | 270 ml |
| Monoethanolamine | 30 ml |

While still wet the two sheets were separated. A true transfer copy in brown color of the original was obtained.

When the same procedure was repeated using a diazotype paper identical to the one from Example No. 13 with the exception that the Base Coat (1) was omitted, no transfer of the diazo layer to the imbibed bond paper took place.

EXAMPLE 14

On a diazotype coating machine, equipped with at least 2 airknife coating stations for precoating and sensitizing, and with high velocity hot air convection dryers after each coating station, a 100% sulfite diazo base paper of 75 g/m² basis weight was treated in sequence on the three coating stations at a coating speed of 2,500 yes/hr with the following preparations:

1. Base coat (applied on the precoat station): The following products were mixed under slight mechanical stirring:

| | |
|---|---|
| Water | 3,500 ml |
| Ammonia (25%) | 60 ml |
| Spherical particles polystyrene pigment dispersion (LYTRON RX 1259, Monsanto Tradename) | 5,600 ml |
| Vinylacetate copolymer | 600 ml |
| Antifoaming agent | 2 ml |

The coat contains 6.5 gms of pigment per square meter of base sheet.

2. Diazo Sensitizing Solution (applied on sensitizing station): The solution was prepared by dissolving the following products under mechanical stirring:

| | |
|---|---|
| Citric acid | 150 g |
| Caffeine | 100 g |
| Thiourea | 500 g |
| Coupler 0 * (see Example 1 supra) | 150 g |
| Coupler No. 910 ** | 110 g |
| Isopropanol | 100 ml |
| Diresorcinol sulfide | 7 g |
| Diazo No. 48 *** (see Example 1 supra) | 250 g |
| Sodium chloride | 100 g |
| Zinc chloride | 250 g |
| Saponin | 3 g |
| Alizarine Irisol | 2 g |
| Vinylacetate polymer dispersion | 100 ml |
| Water, enough to make | 10,000 ml |

After these two treatments, the paper was wound up and placed once more on the unwind stand and passed through the machine again, identically to the first pass except that the untreated side of the paper underwent the two coating applications (1) and (2) described above.

After these treatments the paper was wound up in a commercial manner and was ready for converting into sheets of conventional sizes.

A sample sheet of this paper was used to make a contact copy on each side from a translucent paper master. The copying process was done in the following sequence:

First, one side was exposed behind a translucent master to the print light; second, the other side was exposed behind a translucent master to the print light, and, finally, both sides were developed simultaneously with ammonia vapors.

Prints of deep black lines on a white background were obtained on both sides of the diazotype paper.

When the printing procedure was repeated with a diazotype paper which was prepared identically to the paper of Example No. 14 with the exception that the base coat (1) was omitted and replaced by a conventional, non-colloidal silica precoat, prints were obtained of which the black print lines were of less reflection density than those of the prints of Example No. 14.

Figure 10:
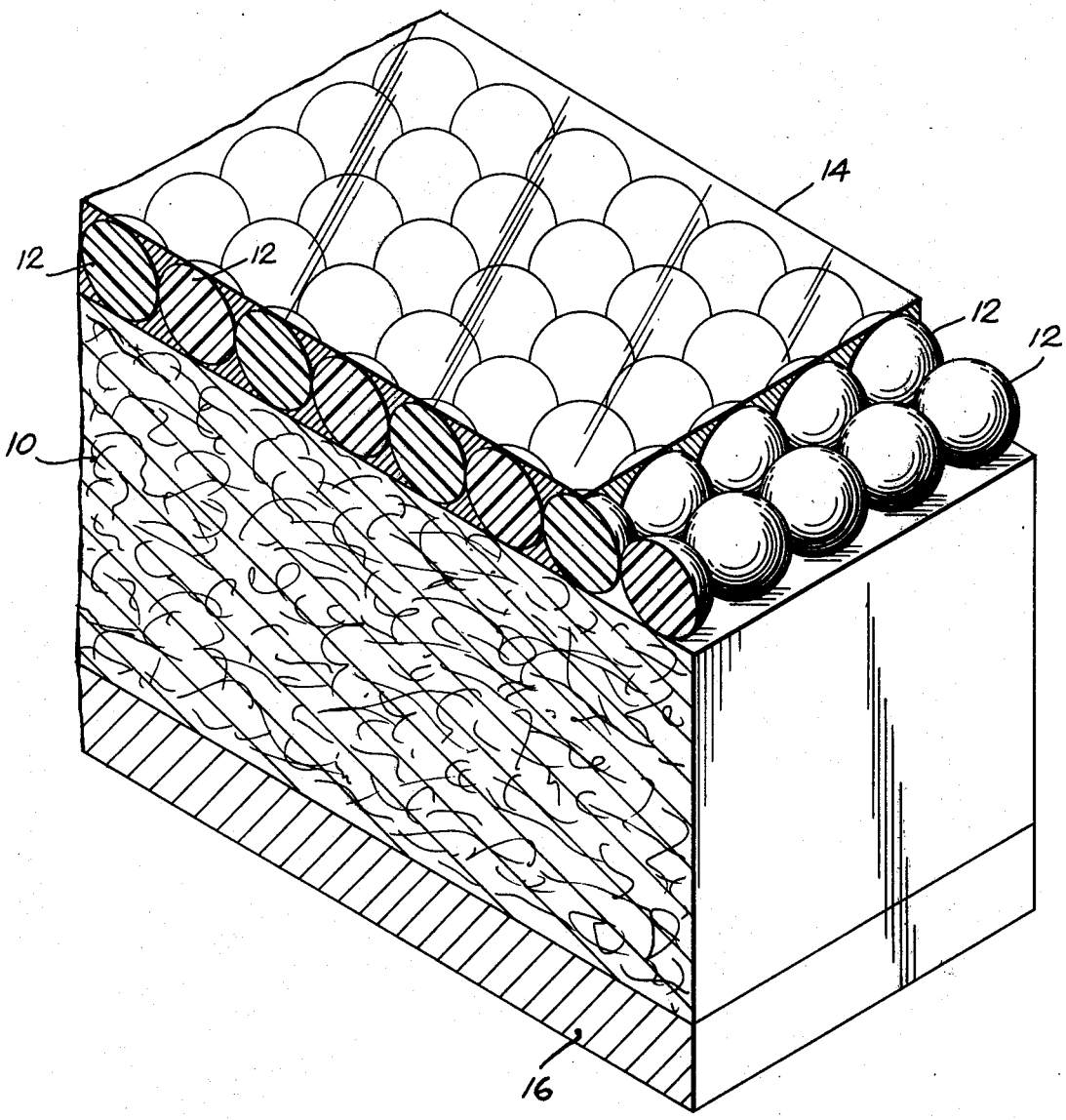
FIG. 10 illustrates the formed matrix for the diazotype components coated on a suitable base sheet.

* *** Supplied by Andrews Paper & Chemical Company
 Coupler No. 910 - Trade name of Andrews Paper for Trihydroxydiphenyl In FIG. 10 there is illustrated in a greatly enlarged section a suitable base sheet 10 such as the types used in Examples 1 through 14. Also, other base sheets may be employed such as films, foils, or the like. Thermoplastic pigment spheric particles 12 are coated on base sheet 10** and are illustrated in a non-fritted condition. For simplicity only one layer of spherical particles is shown while in reality a number of spherical particles overlay each other. Since these particles are thermoplastic, they may be fritted by heating to their softening point or may be treated with a suitable solvent mixture containing xylene which partially dissolves the spheric particles.

A solution of diazotype components 14 is applied over or with the coating of particles 12 and is completely accommodated by the composite of the thermoplastic pigment spheric particles layer 12 which thereby forms the matrix for the diazotype components 14. As noted above, the thermoplastic pigment spheric particles are basically formed of polystyrene such as is available commercially under the tradename of LYTRON RX 1259 by Monsanto or plastic pigment XD 7226 of Dow Chemical Company.

EXAMPLE 15

Repeating the procedures of Example 1, supra, but replacing the (2) diazo sensitizing solution (applied on sensitizing station) by the following composition:

| | |
|---|---|
| Tartaric acid | 90 g |
| Hydrochloric acid (36%) | 50 ml |
| Caffeine | 150 g |
| Phloroglucinol | 100 g |
| Diazo No. 67 (2-diazo-1-hydroxy-naphthalene-5-sulfonic acid, Andrews Paper & Chemical Co., supra) | 200 g |
| Urea | 300 g |
| Thiourea | 300 g |
| Polyethylene glycol | 100 cc |
| Zinc chloride | 125 g |
| Vinylacetate polymer dispersion | 150 ml |
| Water, enough to make | 10,000 ml |

There is obtained a diazotype paper of the invention with blueish full tones and red intermediate tones and having a wide latitude for different print speeds and contrast control.

What is claimed:

1. A diazo reproduction material having wide printing latitude, which comprises:

a base sheet having applied on at least one surface thereof, a coating of diazotype components comprising a light-sensitive compound selected from the group consisting of a diazonium compound and a water soluble naphthoquinone diazide in a matrix prepared from spheric polystyrene particles; said particles having a size of from about 0.15 to about 0.7 microns; said application including bonding said particles together by using a polymer binder in said coating and affixing them to said base sheet; and said coating being applied so that there is from about 4 to about 10 gms of polystyrene per square meter of base sheet.

2. The material of claim 1 wherein said particles are from 0.2 to 0.5 microns in size.

3. The material of claim 1 wherein said coating is applied so that there is from about 5 to about 7.5 gms of polystyrene per square meter of base sheet.

4. The material of claim 1 wherein said coating includes a development aid to facilitate development of the diazo print when using a heat development process.

5. The material of claim 1 wherein the coating is at least particle contact transferable from said base sheet to the surface of a contact sheet.

6. The material of claim 1 wherein said coating is applied to two surfaces of said base sheet.

7. The material of claim 1 wherein said base sheet is transparent.

8. A material according to claim 1 wherein said diazotype components additionally comprise a diazo coupler and an acid stabilizer.

9. A diazo reproduction material according to claim 1 wherein the compound selected is a diazonium compound.

10. A diazo reproduction material according to claim 1 wherein the compound selected is a water soluble naphthoquinone diazide.

* * * * *